US008117954B1

(12) United States Patent
Davis

(10) Patent No.: US 8,117,954 B1
(45) Date of Patent: Feb. 21, 2012

(54) FIREARM MODIFICATION KIT

(76) Inventor: Douglas P. Davis, Grand Bay, AL (US)

( * ) Notice: Subject to any disclaimer, the term of this patent is extended or adjusted under 35 U.S.C. 154(b) by 0 days.

(21) Appl. No.: 12/292,770

(22) Filed: Nov. 26, 2008

(51) Int. Cl.
*B64D 1/04* (2006.01)
*F41F 5/00* (2006.01)

(52) U.S. Cl. ..... 89/1.4; 42/71.01

(58) Field of Classification Search ..... 89/1.4; 42/71.01, 72
See application file for complete search history.

(56) References Cited

U.S. PATENT DOCUMENTS

| | | | | |
|---|---|---|---|---|
| 2,454,885 | A | 11/1948 | Robinson, Jr. | |
| 3,225,653 | A | 12/1965 | Packard | |
| 6,019,024 | A | 2/2000 | Robinson et al. | |
| 6,782,791 | B2 | 8/2004 | Moore | |
| 7,219,463 | B2 * | 5/2007 | Wossner | 42/70.11 |
| 7,231,861 | B1 | 6/2007 | Gauny et al. | |
| 7,261,029 | B1 | 8/2007 | Davis | |
| 2005/0011345 | A1 * | 1/2005 | Herring | 89/1.4 |
| 2006/0156606 | A1 | 7/2006 | Robinson | |

* cited by examiner

*Primary Examiner* — Michelle Clement
(74) *Attorney, Agent, or Firm* — Brian S. Steinberger; Phyllis K. Wood; Law Offices of Brian S. Steinberger, P.A.

(57) ABSTRACT

A kit for modifying a firearm such as a Kalashnikov assault rifle, better known as the AK-47, so as to permit the bolt carrier to be pulled back easily with either the right hand or left hand of a user. The kit includes a receiver cover including an arch-shaped crown and a pair of retaining fins that are affixed to the bottom of the crown. Each of the retaining fins has an upper portion extending outwardly and downwardly from a respective one of the opposed sides of the crown. Each of the retaining fins also has a lower portion that extends downwardly from the bottom of one the upper portions. One of the retaining fins is provided with a slot that extends along the length of its upper portion. A guide track is affixed to the retaining fin having the slot. The guide track has a pair of retaining flanges disposed on opposite sides of the slot. A charging handle assembly is secured to the guide track and includes a slide that is slidably engaged with the retaining flanges and is adapted to move along the length of the guide track. An auxiliary charging handle is affixed to, and projects outwardly from, the slide. An engagement pin is affixed to, and projects inwardly from, the slide. The engagement pin extends through the slot so as to engage the bolt carrier of the firearm and move the bolt carrier when the charging handle is pulled rearwardly.

2 Claims, 3 Drawing Sheets

FIREARM MODIFICATION KIT

FIELD OF THE INVENTION

The present invention relates generally to ordnance and, more particularly, to charging mechanisms for guns.

BACKGROUND OF THE INVENTION

The Kalashnikov assault rifle, better known as the AK-47, and its variants comprise one of the largest groups of firearms on earth. It has been estimated that over 90 million of these firearms have been produced in dozens of countries since their introduction in the Soviet Union in 1946. Developed primarily as a military weapon, the AK-47 became famous for its simplicity of operation and reliability in extreme conditions of use. Because of its mild recoil, the AK-47 has the capability of delivering effective full-automatic fire at a range of 300 meters.

The AK-47 has a few problems that make it less than optimal for use as a weapon of war. One of these, a lack of means to hold the bolt open after the last round is fired from its magazine, was solved by the bolt locking mechanism described in my previously issued U.S. Pat. No. 7,261,029. A currently unresolved problem, however, involves the construction of an AK-47 for the exclusive operation of either a right- or a left-handed user. Thus, a right-handed user can have a difficult time aiming and firing a left-handed AK-47 (made by cutting the charging handle from it normal spot on the right side of a bolt carrier and welding it onto the left side of the bolt carrier) and a left-handed user can have a tough time operating a right-handed AK-47.

For optimum shooting performance, it is important that a user hold an AK-47 by the pistol grip with his strong hand and while looking at the intended target through the sights. (The strong hand of a right-handed user is his right hand, and the strong hand of a left-handed user is his left hand.) To initiate the firing of an AK-47, a bullet is driven from a loaded magazine into an empty chamber by: grasping the AK-47 by the pistol grip with the strong hand, pulling the charging handle to the rear with the weak hand, and then releasing the charging handle. If the configuration of an AK-47 causes a user to hold the pistol grip with his weak hand, the charging process is slowed and a steady aim is lost.

SUMMARY OF THE INVENTION

In view of the problems associated with right- and left-handed variants of the AK-47 assault rifle, it is a principal object of the present invention to provide a kit that permits a user to readily draw the bolt carrier of an AK-47 rearwardly with either his right hand or his left hand thereby making an AK-47 carrying the kit ergonomic.

It is another object of the present invention to provide a kit of the type described that replaces the conventional receiver cover and bolt carrier of an AK-47. The kit can be incorporated into an AK-47 at the time of its manufacture or it can be supplied as an aftermarket product that a user can install. Installation requires just a few moments to accomplish and requires no tools.

Still another object of the invention is to provide a kit of the type described that will not interfere with normal operation of an AK-47 or a variant thereof. Thus, a firearm equipped with the kit will function normally except that reloading is simplified and speeded-up by permitting a user to move the bolt carrier rearwardly with either his right hand or his left hand as desired.

It is an object of the invention to provide improved features and arrangements of features in a kit for the purposes described that is lightweight in construction, inexpensive to manufacture, and fully dependable in use.

Briefly, my kit achieves the intended objects by featuring a receiver cover and bolt carrier of improved construction. The receiver cover includes a pair of retaining fins that are affixed to the bottom of an arched crown. One of the retaining fins is provided with a longitudinal slot. A guide track is affixed to the retaining fin having the slot. The guide track has a pair of retaining flanges disposed on opposite sides of the slot. A charging handle assembly is secured to the guide track and includes a slide that is slidably engaged with the retaining flanges and is adapted to move along the length of the guide track. An auxiliary charging handle is affixed to, and projects outwardly from, the slide. An engagement pin is affixed to, and projects inwardly from, the slide. The engagement pin extends through the slot so as to engage a catch projecting from the bolt carrier.

The foregoing and other objects, features, and advantages of my kit will become readily apparent upon further review of the following detailed description of the kit illustrated in the accompanying drawings.

BRIEF DESCRIPTION OF THE DRAWINGS

My firearm modification kit can be more readily described with reference to the accompanying drawings, in which.

Similar reference characters denote corresponding features consistently throughout the accompanying drawings.

DETAILED DESCRIPTION OF THE FIREARM MODIFICATION KIT

Figure 1:
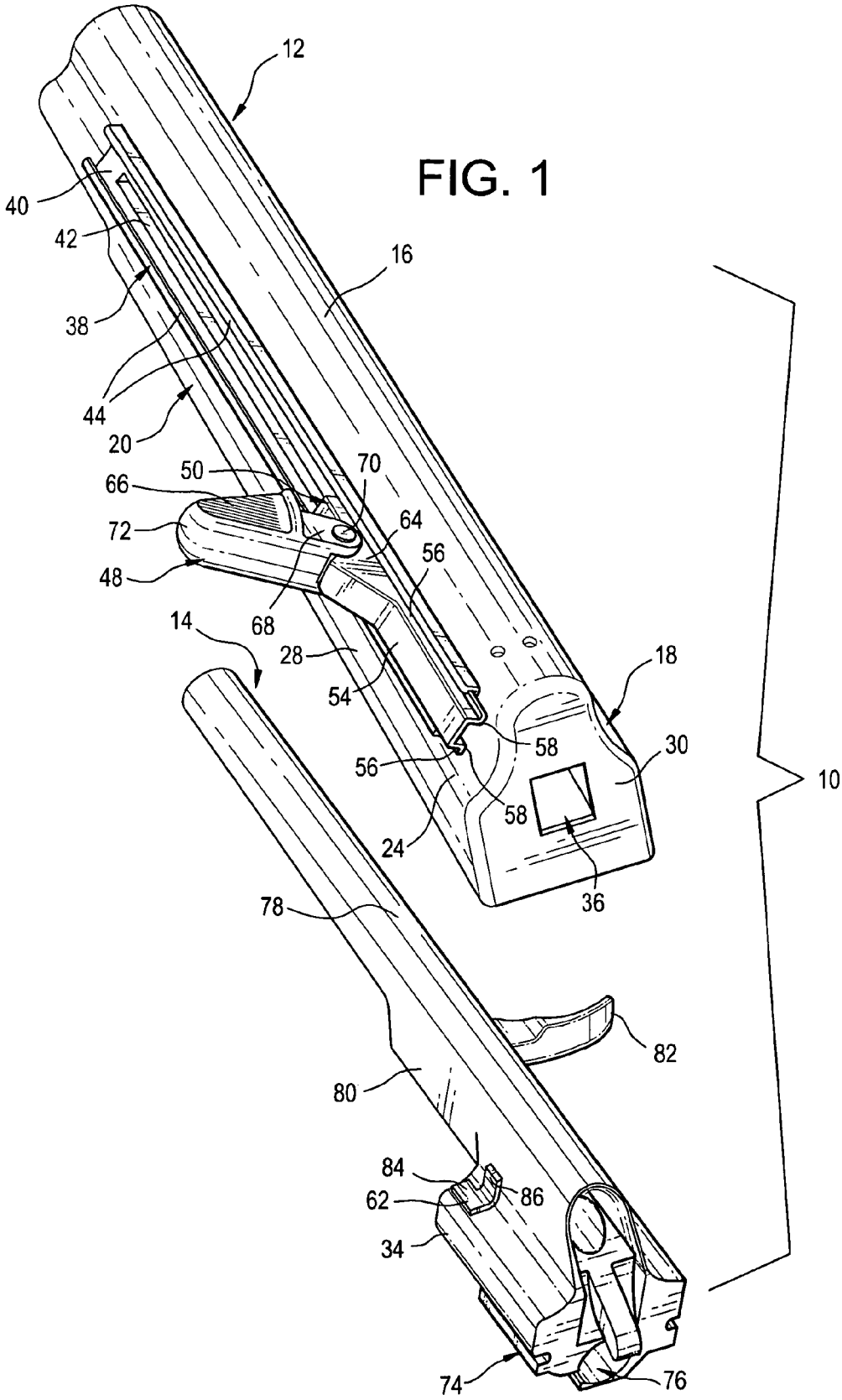
FIG. 1 is an exploded perspective view of a firearm modification kit in accordance with the present invention.
Figure 2:
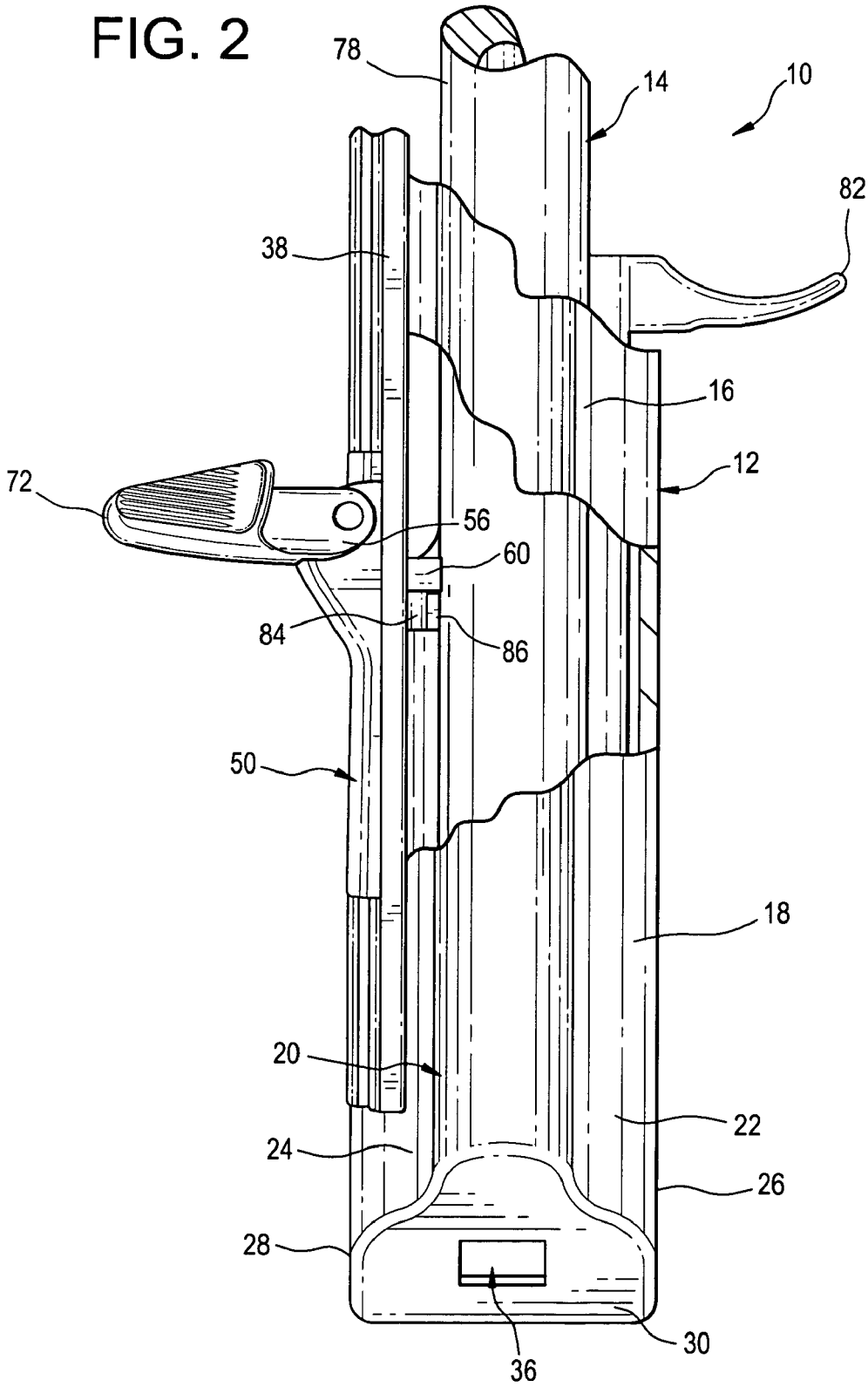
FIG. 2 is a top view of the firearm modification kit of FIG. 1 with portions broken away to reveal details of the kit.
Figure 3:
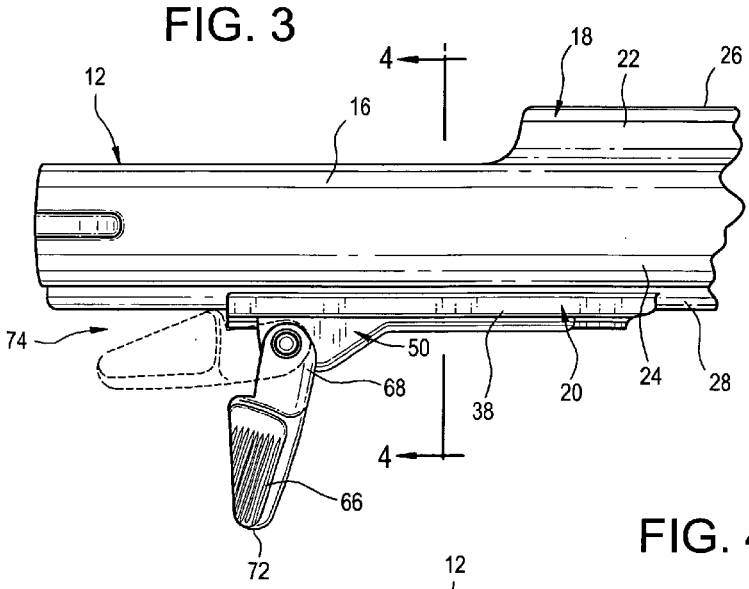
FIG. 3 is a top view of the action cover of the kit showing the pivoting motion of the auxiliary charging handle.
Figure 4:
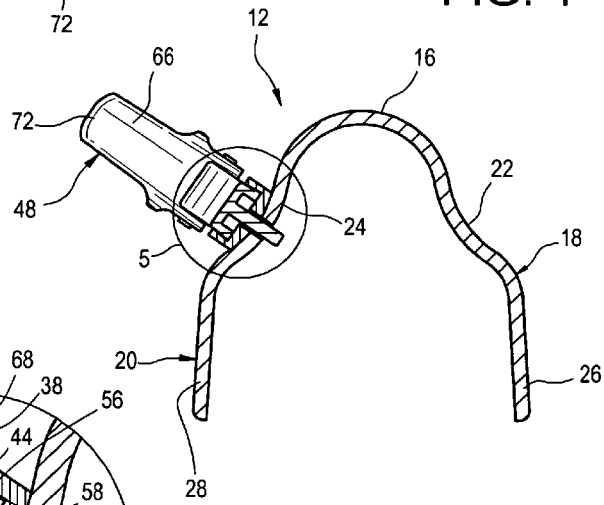
FIG. 4 is a cross-sectional view of the action cover taken along line 4-4 of FIG. 3.
Figure 5:
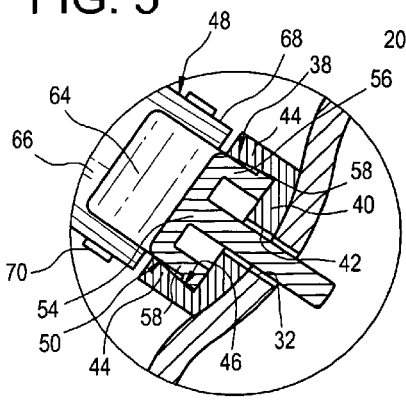
FIG. 5 is an enlarged view of the circled portion of FIG. 4.

Referring now to the FIGS., a firearm modification kit in accordance with the present invention is shown generally at 10. Kit 10 includes a receiver cover 12 and a bolt carrier 14 of improved form. Kit 10 is installed within an AK-47 assault rifle, or variant thereof, hereinafter referred to as a "firearm" and, after installation, becomes an integral part of the firearm. A variant of an AK-47 is described in my U.S. Pat. No. 7,261,029, issued Aug. 28, 2007, which is incorporated herein for its description of a firearm adapted for use with kit 10.

Receiver cover 12 is elongated and arch-shaped, being adapted to snugly, yet slidably, enclose bolt carrier 14 therein. A crown 16, having a configuration resembling that of an inverted "U", defines the top of the arch. A pair of retaining fins 18, 20 is affixed to the bottom of crown 16 and defines the bottom of the arch. Each of fins 18, 20 has an upper portion 22, 24 that extends outwardly and downwardly from a respective one of the opposed sides of crown 16 to provide clearance for bolt carrier 14. Each of fins 18, 20 also has a lower portion 26, 28 that extends downwardly from the bottom of its associated, upper portion 22, 24 for engaging the top of the firearm receiver. A back wall 30 closes the rear portion of the arch and is affixed to crown 16 as well as upper portion 22, 24 and lower portion 26, 28 of both retaining fins 18, 20.

Receiver cover 12 is provided with a number of openings. An elongated slot 32 extends longitudinally along the retaining fin 20 on the left side of receiver cover 12. Specifically, slot 32 is located midway between the top and bottom of upper portion 24. Slot 32 extends from a forward point adjacent the forwardmost position of travel of the base block 34 of bolt carrier 14 (described more fully hereinbelow) in a firearm receiver to a rearward point adjacent the rearwardmost position of movement of the front of base block 34 in the receiver. A rectangular hole 36 is also provided in the center of back wall 30 for receiving a recoil spring base.

A guide track 38 is affixed to retaining fin 20. Guide track 38 has an elongated, base plate 40 that is positioned flush against the upper portion 24. Base plate 40 has a longitudinal slot 42 therein that is dimensioned and positioned so as to be coextensive with slot 32. Base plate 40, thus, serves to reinforce retaining fin 20 in the area around slot 32. Affixed to the opposite sides of base plate 40 is a pair of retaining flanges 44 that extends outwardly from the base plate 40 so as to terminate at free ends remote from retaining fin 20. Each of the retaining flanges 44 tapers in terms of its width such that it is widest at its free end and narrowest along its connection to base plate 40. The taper results in retaining flanges 44 both overhanging base plate 40 along their lengths and defining a pair of opposed grooves as at 46.

A charging handle assembly 48 is affixed to guide track 38. Assembly 48 includes a slide 50 that is selectively moved in grooves 46 along the length of guide track 38 and an auxiliary charging handle 52 that is pivotally secured to slide 50. When not needed, auxiliary charging handle 52 can be pivoted to a stowage position against receiver cover 12 to facilitate the easy handling and transport of a firearm.

Slide 50 engages guide track 38 and has an elongated guide body 54 that is positioned between retaining flanges 44 of guide track 38. Affixed to the opposite sides of guide body 54 is a pair of retaining arms 56 that extends from the guide body 54 so as to terminate at free ends adjacent grooves 46 in guide track 38. One of a pair of retaining fingers 58 is affixed to the free end of each of retaining arms 56. Each of the retaining fingers 58 projects outwardly from a respective one of the retaining arms 56 and into a respective one of grooves 46. Retaining fingers 58 are adapted for slidable movement in grooves 46.

Slide 50 also includes an engagement pin 60 that is affixed to the bottom of guide body 54. Engagement pin 60 extends inwardly from guide body 54 and through slots 32, 42. Pin 60, then, projects inwardly from the upper portion 24 of fin 20 and is adapted to both slide within slots 32, 42 and engage catch 62 of bolt carrier 14. Pin 60 engages the front and rear ends of slots 32, 42 and serves as a stop against the continued movement of slide 50 from guide track 38.

Slide 50 further includes a handle retaining tab 64 that is affixed to the top of guide body 54. Handle retaining tab 64 projects outwardly from guide body 54 away from guide track 38. Auxiliary charging handle 52 is pivotally secured to handle retaining tab 64.

Auxiliary charging handle 52 includes a handle body 66 from which a pair of handle retaining fins 68 projects. Retaining fins 68 are respectively pivotally affixed to the top and bottom of handle retaining tab 64 by means of a pivot pin 70. Handle body 66 tapers toward its outer, free end 72 that, when handle 52 is pivoted fully toward guide track 38, is located a small distance 74 from upper portion 24 of retaining fin 20 so that a finger of a user can easily pivot handle 52 outwardly. When pivoted outwardly, handle body 66 abuts against retaining tab 64 to limit the range of pivoting motion of auxiliary charging handle 52 to about 90°.

Bolt carrier 14 moves a bolt within a receiver of a firearm. Bolt carrier 14 includes a base block 34 having longitudinal grooves 74 in its opposite sides for slidably engaging carrier guides in the receiver. A longitudinal bore 76 passes through base block 34 between longitudinal grooves 74 and is sized to receive the firearm bolt. A tubular sleeve 78 is affixed to the top of base block 34 and extends forwardly from base block 34. Sleeve 78 receives a recoil spring and a spring guide within its confines. Beneath sleeve 78 and forwardly of bore 76, bolt carrier 14 is provided with a slotted guideway 80 that receives a stud extending from the bolt. A primary charging handle 82 is affixed to the right side of guideway 80 and projects laterally from guideway. Charging handle 82 reciprocates outside of the receiver when the firearm is fired.

A catch 62 projects from the left side of bolt carrier 14 for selective engagement with engagement pin 60. As shown, catch 62 has a configuration resembling that of a reversed "L". Catch 62 has a horizontal member 84 that is affixed to both the front and top of base block 34. Catch 62 also has a vertical member 86 that projects upwardly from the rear of horizontal member 84 and flush with tubular sleeve 78 to which vertical member 86 is affixed. Catch 62 is made by integrally casting it with the remainder of bolt carrier 14 or by adding it later by means of penetrating fasteners, welding or brazing.

Use of kit 10 is straightforward. First, bolt carrier 14 and receiver cover 12 are substituted for corresponding parts within a firearm in the usual manner. Next, assuming that a left-handed user wishes to easily discharge the firearm, a bullet is driven from the firearm's loaded magazine and into the empty chamber by: grasping the firearm's pistol grip with his left hand, pulling auxiliary charging handle 52 to the rear with his right hand, and, then, releasing auxiliary charging handle 52. The firearm's spring-loaded action then returns charging handle 53 to its original, forward position at the front of guide track 38. (Handle body 66 can, if desired, be manually pivoted toward fin 20 for stowage and subsequent use.) As auxiliary charging handle 52 is pulled backwardly, engagement pin 60 grasps vertical member 86 of catch 62 of bolt carrier 14 and draw's bolt carrier 14 rearwardly such that the action of the firearm is caused to chamber a bullet. The entire process of chambering a bullet requires only moments to complete and can be achieved without the left-handed user either taking his eyes away from his intended target or aiming the firearm away from an intended target.

Kit 10 is intended to accommodate the use of a folding firearm stock and side-mounted optics since charging handle assembly 48 does not reciprocate with bolt carrier 14 when the firearm is discharged. Perhaps, with side-mounted optics, only the primary charging handle 82 need be employed. Kit 10, of course, allows a user to charge the firearm with either the right or left hand.

While kit 10 has been described with a high degree of particularity, it will be appreciated by individuals having experience with firearms that modifications can be made to kit 10. For example, auxiliary charging handle 52 need not be made to pivot, but could be integrally formed with the balance of slide 50. Furthermore, by modifying engagement pin 60 so as to hit the front edge of base block 34, it is possible to eliminate catch 62. Catch 62, however, does provide a strong junction between receiver cover 12 and bolt carrier 14. Thus, it must be understood that my invention is not limited merely to kit 10, but rather it encompasses any and all kits within the scope of the following patent claims.

I claim:

1. A kit for modifying a firearm having a receiver and a bolt being positioned in the receiver, said kit comprising:

a receiver cover for covering the receiver of the firearm, said receiver cover including:

an arch-shaped crown having opposed sides;

a pair of retaining fins being affixed to the bottom of said crown, each of said retaining fins including:

an upper portion extending outwardly and downwardly from a respective one of said opposed sides of said crown; and, a lower portion extending downwardly from the bottom of one said upper portion for engaging the top of the receiver of the firearm;

one of said retaining fins being provided with a slot and said slot extending along the length of one said upper portion;

one of said retaining fins not having said slot;

a guide track being affixed to said one of said retaining fins being provided with said slot, said guide track having a pair of retaining flanges being disposed on opposite sides of said slot;

a charging handle assembly being secured to said guide track, said charging handle assembly including:

a slide being slidably engaged with said retaining flanges and being adapted to move along the length of said guide track;

an auxiliary charging handle being affixed to, and projecting outwardly from, said slide; and, an engagement pin being affixed to, and projecting inwardly from, said slide, said engagement pin extending through said slot; and, a bolt carrier being positioned within the receiver of the firearm beneath said receiver cover, said bolt carrier including:

a base block for slidably engaging said receiver, said base block having a longitudinal bore in the bottom thereof for carrying the bolt, and said base block being in selective engagement with said engagement pin;

an elongated, tubular sleeve being affixed atop said base block;

a slotted guideway being disposed forwardly of said longitudinal bore and beneath said sleeve; and, a primary charging handle being affixed to said guideway and extending therefrom in a direction being generally opposite of that of said auxiliary charging handle and outwardly from said receiver cover beneath said retaining fin not having said slot.

2. A kit for modifying a firearm having a receiver and a bolt being positioned in the receiver, said kit comprising:

a receiver cover for covering the receiver of the firearm, said receiver cover including:

an arch-shaped crown having opposed sides;

a pair of retaining fins being affixed to the bottom of said crown, each of said retaining fins including:

an upper portion extending outwardly and downwardly from a respective one of said opposed sides of said crown; and, a lower portion extending downwardly from the bottom of one said upper portion for engaging the top of the receiver of the firearm;

one of said retaining fins being provided with a slot and said slot extending along the length of one said upper portion;

one of said retaining fins not having said slot;

a guide track being affixed to said one of said retaining fins being provided with said slot, said guide track having a pair retaining flanges being disposed on opposite sides of said slot;

a charging handle assembly being secured to said guide track, said charging handle assembly including:

a slide being slidably engaged with said retaining flanges and being adapted to move along the length of said guide track;

an auxiliary charging handle being pivotally secured to, and projecting outwardly from, said slide; and, an engagement pin being affixed to, and projecting inwardly from, said slide, said engagement pin extending through said slot; and, a bolt carrier being positioned within the receiver of the firearm beneath said receiver cover, said bolt carrier including:

a base block for slidably engaging said receiver, said base block having a longitudinal bore in the bottom thereof for carrying the bolt, and said base block having an outwardly projecting catch for selective engagement with said engagement pin;

an elongated, tubular sleeve being affixed atop said base block;

a slotted guideway being disposed forwardly of said longitudinal bore and beneath said sleeve; and, a primary charging handle being affixed to said guideway and extending therefrom in a direction being generally opposite of that of said auxiliary charging handle and outwardly from said receiver cover beneath said retaining fin not having said slot.

* * * * *